United States Patent [19]

Greenwood

[11] Patent Number: 5,054,392

[45] Date of Patent: Oct. 8, 1991

[54] LITHOGRAPHIC PRINTING PRESS HAVING AN INK DUCT WITH A DIVIDED CHAMBER

[75] Inventor: Richard P. Greenwood, Skipton, United Kingdom

[73] Assignee: Vickers plc, United Kingdom

[21] Appl. No.: 422,520

[22] Filed: Oct. 18, 1989

[30] Foreign Application Priority Data

Oct. 31, 1988 [GB] United Kingdom ..... 8825412
Aug. 29, 1989 [GB] United Kingdom ..... 8919515

[51] Int. Cl.[5] ..... B41F 31/08

[52] U.S. Cl. ..... 101/142; 101/169; 101/366

[58] Field of Search ..... 101/366, 157, 169, 142

[56] References Cited

U.S. PATENT DOCUMENTS

| | | | |
|---|---|---|---|
| 2,018,193 | 10/1935 | Smith | 101/157 X |
| 3,044,396 | 7/1962 | Aller | 101/157 |
| 3,046,885 | 7/1962 | Neal | 101/366 X |
| 4,009,657 | 3/1977 | Bonanno et al. | 101/366 X |
| 4,066,014 | 1/1978 | van Haaften | 101/157 |
| 4,488,483 | 12/1984 | Kohara | 101/350 X |
| 4,590,855 | 5/1986 | Schommer et al. | 101/157 |
| 4,625,643 | 12/1986 | Davis | 101/363 |
| 4,627,350 | 12/1986 | Sato et al. | 101/169 X |

FOREIGN PATENT DOCUMENTS

| | | | |
|---|---|---|---|
| 199520 | 10/1986 | European Pat. Off. | 101/154 |
| 0286305 | 10/1988 | European Pat. Off. | 101/366 |
| 278225 | 5/1990 | European Pat. Off. . | |
| 1100041 | 2/1961 | Fed. Rep. of Germany | 101/366 |
| 1954316 | 5/1971 | Fed. Rep. of Germany | 101/366 |
| 719994 | 12/1954 | United Kingdom | 101/366 |

*Primary Examiner*—Clifford D. Crowder
*Attorney, Agent, or Firm*—Laff, Whitesel, Conte & Saret

[57] ABSTRACT

An ink duct for applying ink to the surface of a roller mounted for rotation about its cylindrical axis comprises a chamber having an open side capable of being substantially closed by the roller surface and bounded by an axially extending doctor blade having an edge protruding towards the open side for contacting the roller surface, an axially extending sealing member having an edge protruding towards the open side, and end seals linking the blade and the sealing member at their ends and having edges protruding towards the open side for sealing engagement with the roller surface. The chamber includes an axially extending projection located between the blade and the sealing member and having an edge protruding towards the open side to divide the chamber into first and second zones while allowing ink to flow past the edge from the first zone to the second zone. A first axially extending slot is provided in the first zone for the introduction of ink into the first zone and an outlet is provided in the second zone for egress of ink from the second zone. A lithographic printing press includes two of said ink ducts pivotally mounted so that one or the other may be engaged with the surface of the roller.

10 Claims, 5 Drawing Sheets

LITHOGRAPHIC PRINTING PRESS HAVING AN INK DUCT WITH A DIVIDED CHAMBER

Figure 1:
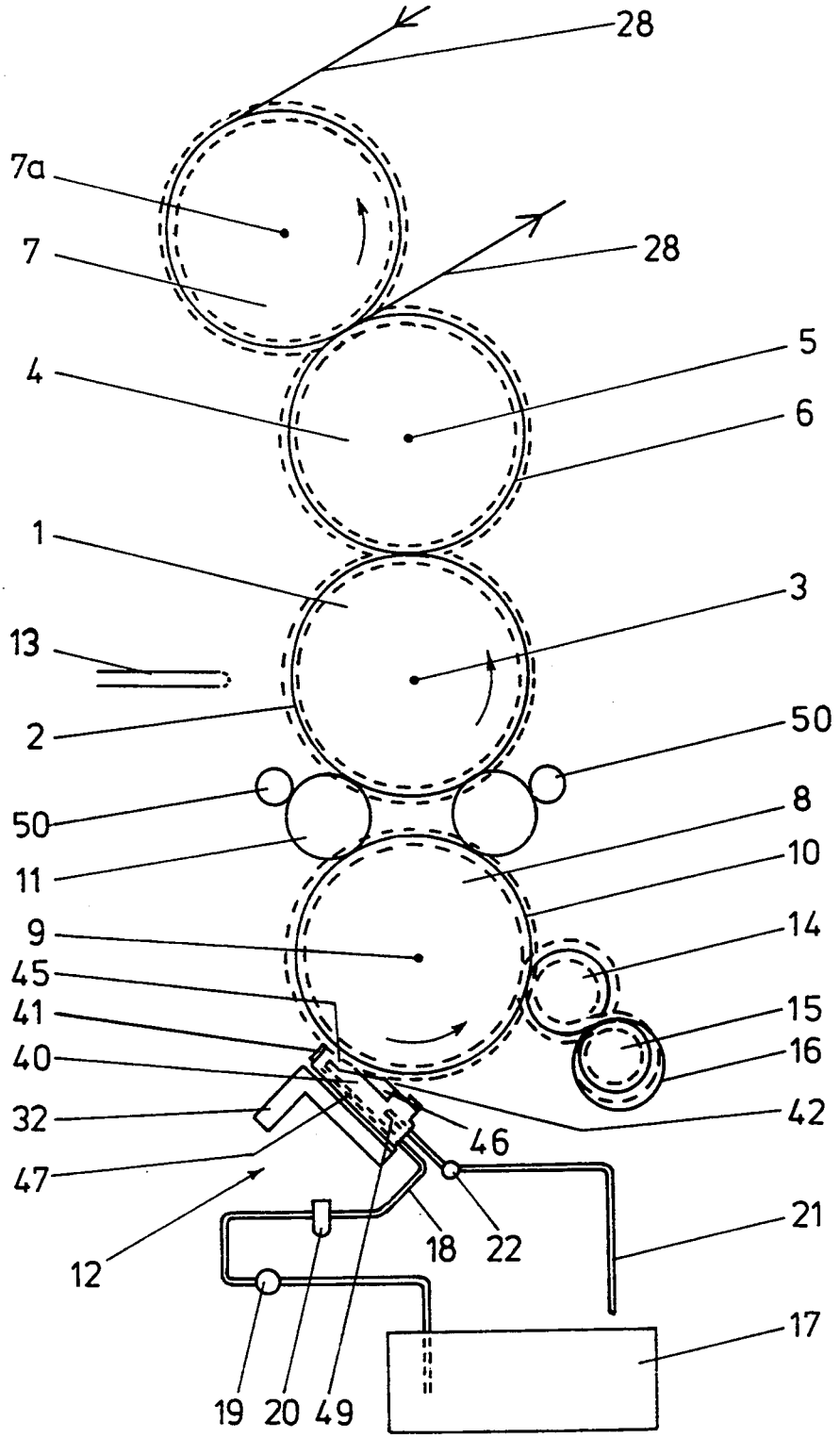

This invention relates to lithographic printing and is concerned with a lithographic printing press having a novel ink-applying mechanism.

Lithographic printing plates include a printing image area which is substantially co-planar with the non-printing area and the lithographic printing process relies on the differing affinities of these areas towards ink and water. The printing image is normally water repellent and ink receptive and the non-printing area is water receptive and ink repellent.

The lithographic printing plate is mounted on a plate cylinder and, during printing, an aqueous fountain solution is applied to the plate usually by means of a roller system or by a series of spray nozzles, the quantity of fountain solution applied being adjustable. The solution wets the non-printing area and is repelled by the printing image. Greasy lithographic printing ink is then applied to the plate. This is repelled by the wet non-printing area and received by the printing image. The ink is then transferred from the printing image to the material to be printed, generally via the intermediary of an offset blanket.

Typically the ink is applied to the printing plate by an ink duct which includes a duct blade co-operating with the duct roller of the press unit. Ink is transferred from the duct roller to the printing plate via a series of rollers and the amount of ink received by the plate depends upon the amount of ink carried by the duct roller. The amount of ink carried by the duct roller is determined by a gap between the blade and the duct roller and this gap is controlled by a plurality of keys located at intervals along the blade. These keys need to be adjusted in order to obtain the correct ink level on the plate and such adjustment is time consuming and requires considerable skill. Alternatively, the adjustment of the duct blade can be carried out by electro-mechanical means to enable remote control to be achieved. The reliability and cost of such complex systems is however a disadvantage. Until such time as the correct ink/water balance is achieved, the printed copies produced are unsatisfactory and thus there is much wastage.

It is an object of the present invention to provide a means of applying ink to a lithographic printing plate which does not suffer from such disadvantages.

According to one aspect of the present invention there is provided an ink duct for containing ink under pressure for applying the same to the surface of a roller mounted for rotation about its cylindrical axis, which duct comprises a chamber having:

(i) an open side capable of being substantially closed by the roller surface and bounded by
  (a) an axially extending blade having an edge protruding towards the open side for contacting the roller surface to exert a doctoring action thereon,
  (b) an axially extending sealing member having an edge protruding towards the open side for contacting, or for being slightly spaced from, the roller surface, and
  (c) end seals linking the blade and the sealing member at their ends and having edges protruding towards the open side for sealing engagement with the roller surface, (ii) an axially extending projection located between the blade and the sealing member and having an edge protruding towards the open side to divide the chamber into first and second zones whilst allowing ink to flow past the edge from the first zone to the second zone, (iii) an axially extending slot in the first zone for the introduction of ink into the first zone, and (iv) an outlet in the second zone for egress of ink from the second zone.

Conventionally, when replacing the printing plate of a lithographic printing press, it is necessary to reverse the direction of rotation of the plate cylinder.

Thus, when replacing the printing plate of a press fitted with the ink duct of the invention, the roller to which the ink is applied by the duct also has to rotate in the reverse direction. In the case where the sealing member is spaced from the roller, this results in ink being carried past the sealing member and this ink may contaminate the press. In accordance with a particular preferred embodiment, this problem is avoided by providing the chamber with an additional axially extended blade on the opposite side of the sealing member to the axially extending projection. This additional blade contacts the roller to remove ink carried beyond the sealing member on reverse rotation of the roller and forms another zone at said opposite side, said another zone including an outlet for egress of ink which also allows air at ambient pressure to enter.

According to another aspect of the present invention there is provided a lithographic printing press comprising:

(i) a plate cylinder mounted for rotation about its cylindrical axis and adapted to receive a lithographic printing plate, (ii) a means of applying an aqueous fountain solution to the lithographic printing plate, (iii) an inking device for applying ink to an engraved roller mounted for rotation about its cylindrical axis and having a cylindrical surface provided with a plurality of cells, said device comprising:
  (a) an ink duct as defined above for containing ink under pressure,
  (b) a means of supplying ink from an ink source to the slot of the first zone of the chamber of the duct and thence into contact with said surface and into said cells, and
  (c) a means of returning ink from the outlet of the second zone of the chamber of the duct to said source, (iv) a means of transferring ink from said cells to the lithographic printing plate, and (v) a means of transferring ink from said lithographic printing plate to material to be printed.

In some cases, it is frequently desired to run a lithographic press in the reverse direction when printing in a different colour. In this case, it is necessary for another ink duct to be incorporated which co-operates with the roller when rotating in the reverse direction. In a particularly preferred embodiment of the present invention the two ink ducts are mounted on a support which is pivotable about a horizontal axis so that by suitably pivoting the support about said axis, either a first of said ink ducts can be brought into co-operation with a first part of the cylindrical surface of the roller or a second of said ink ducts can be brought into co-operation with a second part of the cylindrical surface of the roller.

The axially extending sealing member will generally be spaced from the roller surface and typically the gap between the sealing member and the roller surface will be less than 1.0 mm and preferably less than 0.5 mm. However, in some circumstances it may be desirable for the axially extending sealing member to be in contact with the roller surface.

The cells on the roller surface may be provided by, for example, mechanical or electronic engraving in the case where the roller is steel or laser engraving in the case where the roller has a ceramic surface. The cells may be defined by from 150 to 500 lines per inch and the cells may be from 0.0002 to 0.010 thousandths of an inch deep.

During printing the ink duct becomes pressurised to a pressure of from 1 to 10 psi and the ink becomes deaerated and its rheology is adjusted. The ink is forced into the cells of the roller surface and it is believed that the ink completely fills the cells and thus prevents any possibility of excess fountain solution entering the cells and subsequently being transferred to the printing image. Moreover, the correct ink/water balance can be set up very quickly as a constant film of ink is applied to the printing image thus reducing the need for skilled operatives.

The presence of the slots serving as ink inlets and outlets to the first and second zones results in an improved flow of ink through the duct. In a particularly preferred embodiment, the duct includes a first axially extending reservoir communicating with the first slot along their respective axial lengths. In this case, ink may be fed to the first reservoir from the source by one or more conduits. Additionally, the duct may include a second axially extending reservoir communicating with the second slot along their respective axial lengths. In this case, ink may be conveyed from the second reservoir to the source by one or more conduits. The second axially extending reservoir may include partitions to divide the reservoir into a plurality of compartments arranged along the length of the duct, each of which includes at least one of said conduits to convey ink from the reservoir to the source. Generally, the second slot will be wider than the first slot.

The inking device may be a single device extending along the entire axial length of the roller surface and sealed at the ends of said surface so that it has a width corresponding to the maximum width of the material to be printed. Alternatively, the press may include a plurality of narrower inking device closely arranged together side by side along the axial length of the roller surface with each device being individually sealed at its ends against the roller surface. This enables the printing of a material narrower than the normal maximum width simply by taking the superfluous device(s) out of service or by removing the superfluous device(s). In this way, the number of inking devices to be used in a given case can be selected in dependence upon the width of the material being printed. Moreover, a particularly useful advantage of this embodiment is that the inking devices may be mounted on the printing press in such a way that they can be readily detached and be replaced by another inking device (together with its ink reservoir containing ink of a different colour and its associated ink feed and discharge pipes) so that different colour printing across the full width of the material is readily facilitated. Moreover, it is particularly preferred for these detachable inking devices to be interchangeable, one with the other, along the axial length of the roller surface to facilitate printing in different colours. Alternatively this can be achieved by feeding different coloured inks to the inking devices without detaching and replacing the devices.

The fountain solution may be applied directly to the printing plate or to some other part of the press for subsequent transfer to the printing plate. Rollers of various types or sprays may be used to apply the fountain solution.

Figure 2:
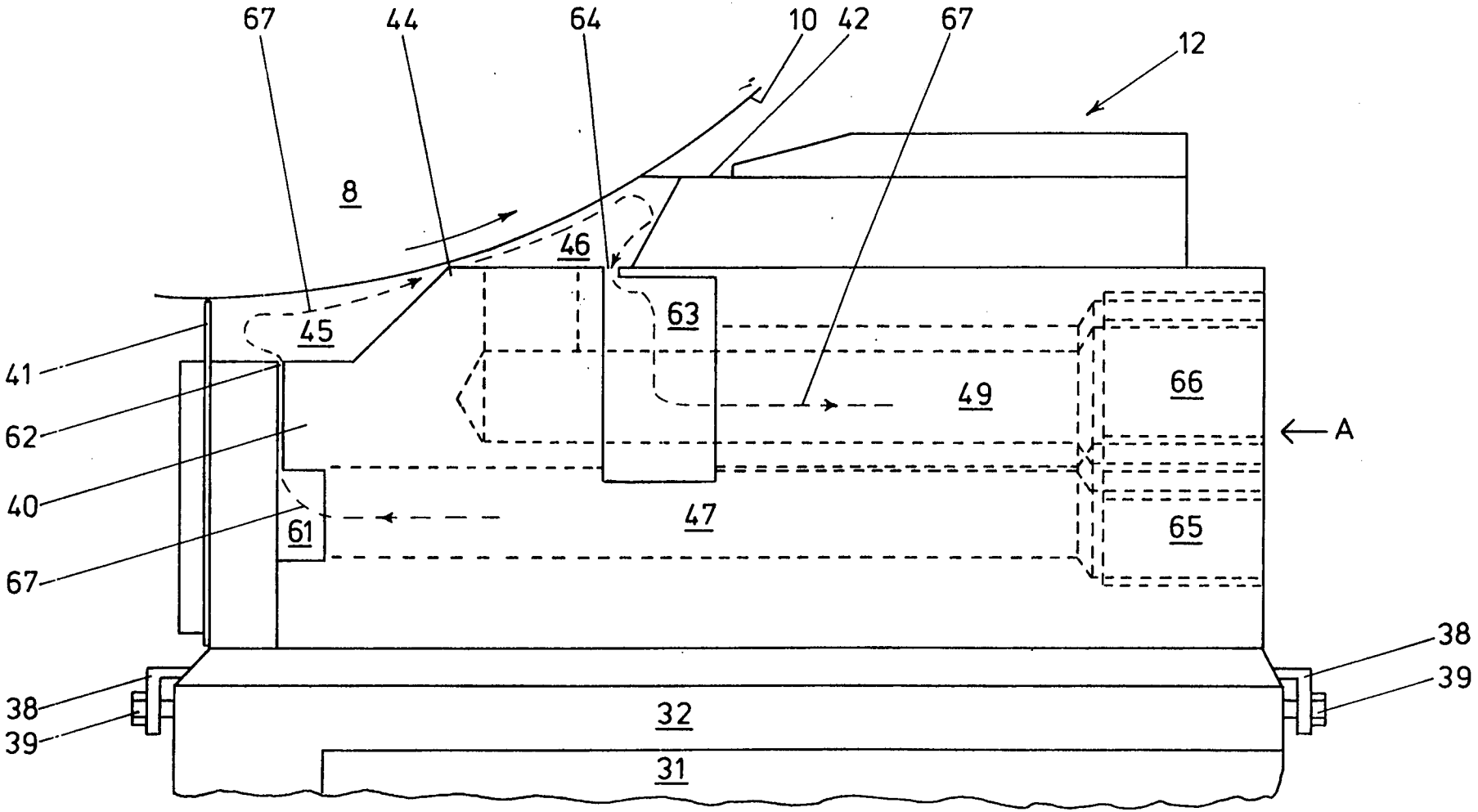
Figure 3:
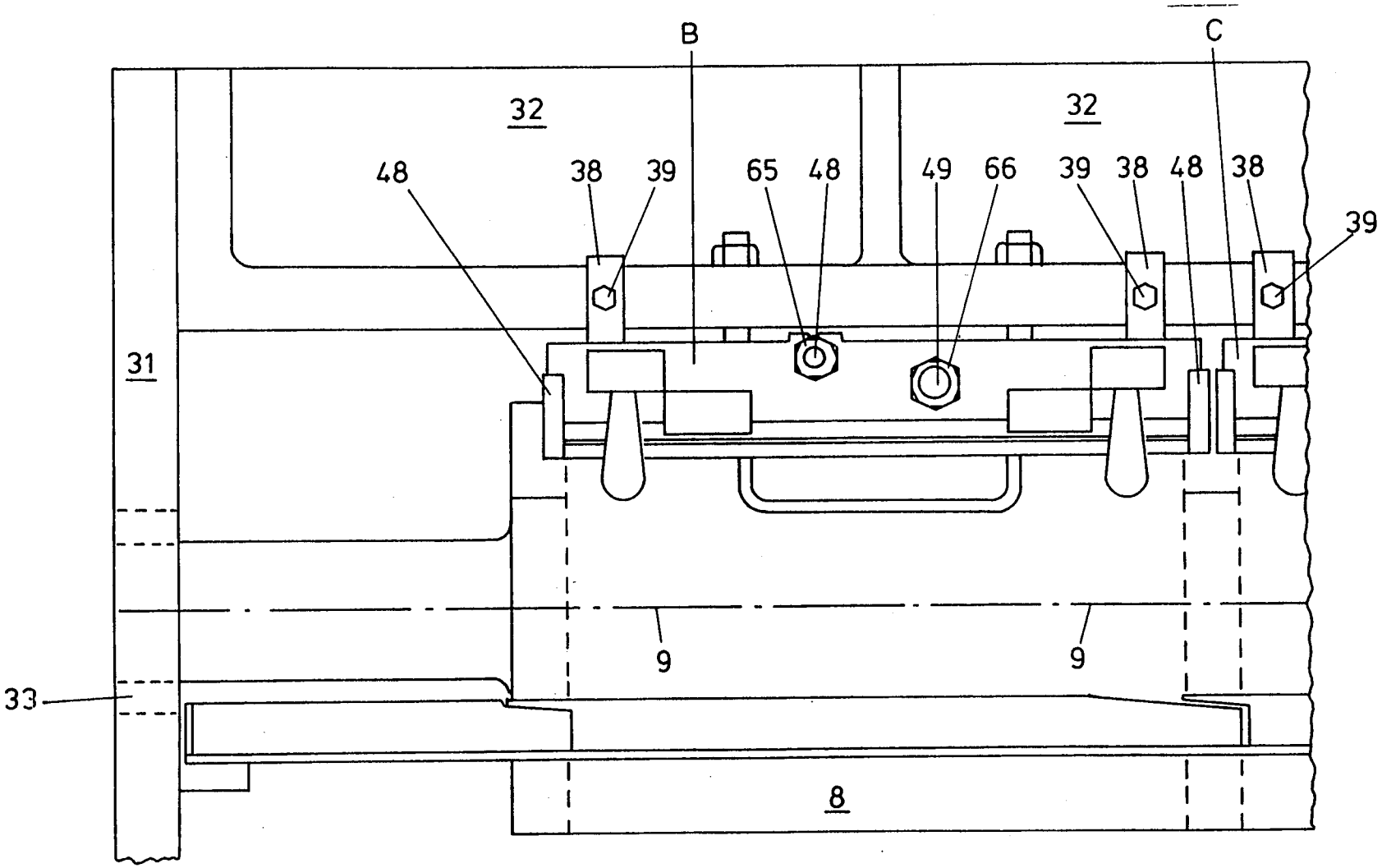
Figure 4:
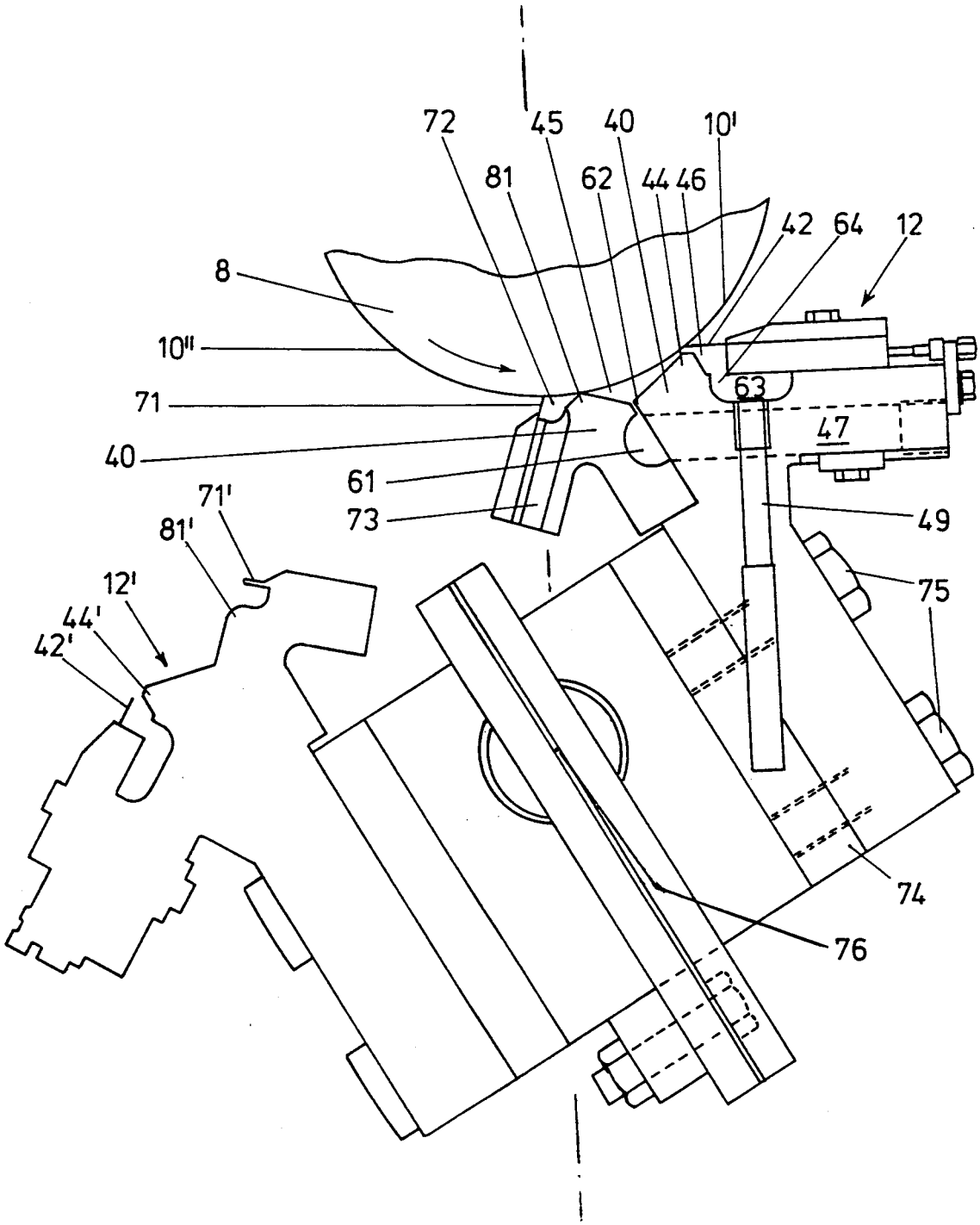
Figure 5:
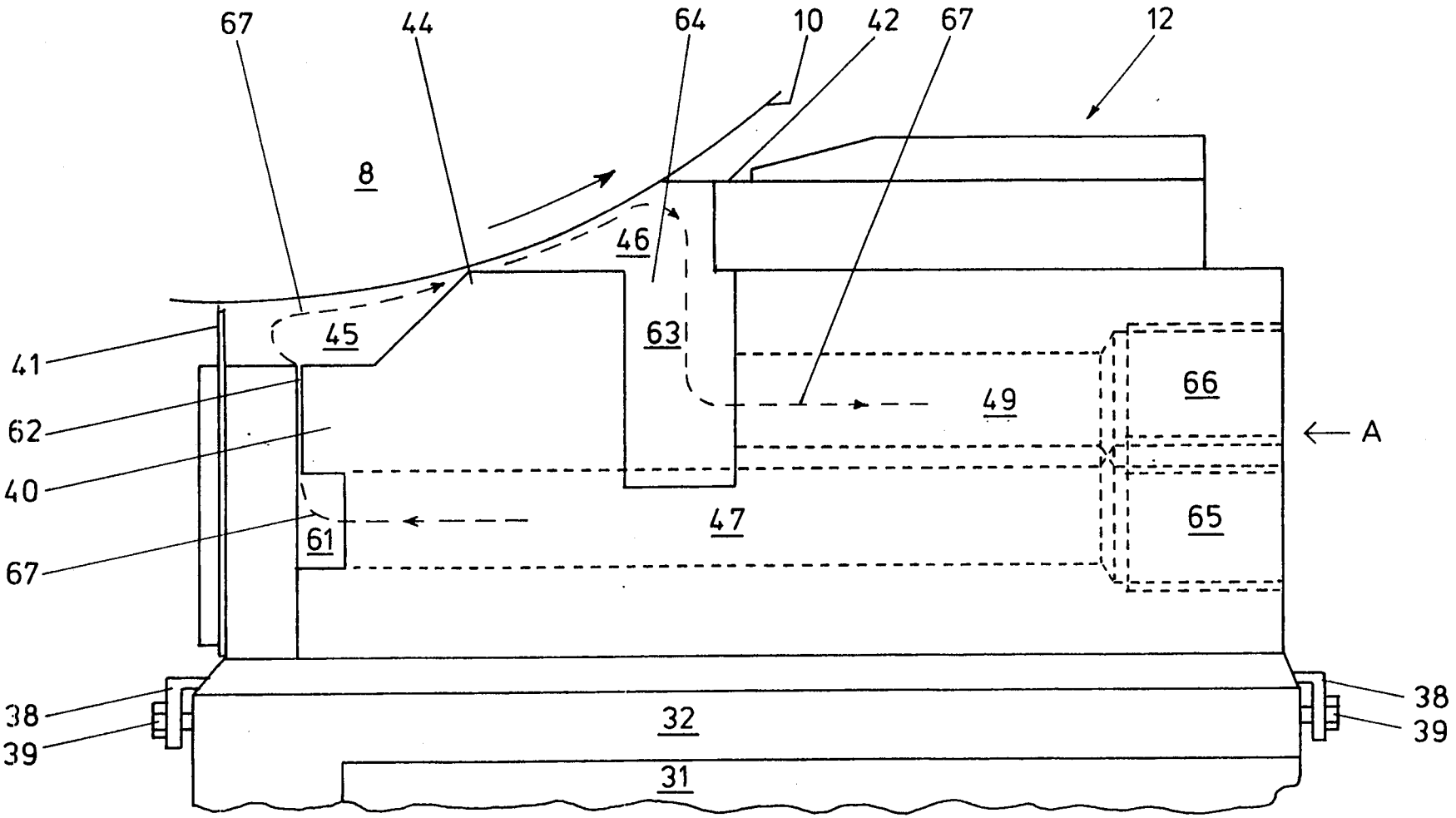

For a better understanding of the invention and to show how the same may be carried into effect, reference will now be made, by way of example, to the accompanying drawings in which:

FIG. 1 is a diagrammatic side view of a lithographic printing press in accordance with the present invention, FIG. 2 is a side view of a part of the lithographic printing press shown in FIG. 1, FIG. 3 is a view of the part of FIG. 2 in the direction A showing a part of the press width, FIG. 4 shows a vertical section through a part of a second lithographic printing press in accordance with the present invention, and FIG. 5 is a side view, corresponding to FIG. 2, of a part of a third lithographic printing press in accordance with the present invention.

Referring first to FIG. 1, the lithographic printing press comprises a plate cylinder 1 adapted to carry a lithographic printing plate 2 on its circumferential surface and mounted for rotation about its cylindrical axis 3. The press includes a blanket cylinder 4 mounted for rotation about its cylindrical axis 5 and carrying, on its circumferential surface, a resilient blanket 6. An impression cylinder 7 mounted for rotation about its cylindrical axis *7a* is provided to define a nip for the paper or the like with the blanket cylinder 4. The press also includes an engraved roller 8 for applying ink to the lithographic printing plate 2 on the plate cylinder 1. The roller 8 is mounted for rotation about its cylindrical axis 9 and it has a circumferential surface 10 which is provided with a plurality of cells. Located between roller 8 and plate cylinder 1 is a pair of resilient forme rollers 11 which run in contact with the surface 10 of the roller 8 and the surface of the printing plate 2 on the plate cylinder 1. (If desired, more than two forme rollers or a single forme roller may be provided). An inking device generally denoted by reference numeral 12 is provided to apply ink to the surface of the roller 8 and a spray device generally denoted by reference numeral 13 is provided to apply aqueous fountain solution directly to the surface of the printing plate 2 on the plate cylinder 1.

The roller 8 carries a gear ring which is in mesh with a gear 14 which in turn is in mesh with a gear 15 driven by main press motor 16. Plate cylinder 1, blanket cylinder 4 and impression cylinder 7 also carry gear rings so that they are geared together and the gear ring of the plate cylinder 1 is similarly driven by the main press drive motor 16 via gears (not shown).

The inking device 12 receives ink from a source in the form of a reservoir 17 via pipe 18 and pump 19 and filter 20 and ink is returned from the inking device 12 to the reservoir 17 via pipe 21 and a pressure relief valve 22. Alternatively, the valve 22 may be replaced or supplemented by a vent of predetermined size.

Referring now to FIGS. 2 and 3, these show a part of one side only of the press. The other side corresponds and hence has been omitted in the interests of clarity.

The printing press comprises a pair of side frames 31 (one side frame only being shown) with a rigid cast iron stretcher 32 pivotally mounted between the two. The roller 8 is mounted for rotation about its cylindrical axis 9 in journals 33 carried by the side frames. The press may include a plurality of such printing units (not shown) in which case they will all be driven by a suitable drive mechanism in conventional manner by the motor 16.

A plurality of inking devices (each of which may have a separate ink reservoir 17) is included in the printing press to apply ink to the printing image. Two of these are denoted by references B and C (FIG. 3). Each inking device is secured to the stretcher 32 by means of retaining plates 38 clamped to the stretcher 32 by bolts 39. Up to four such inking devices may be provided and they are mounted on the printing unit side by side along the axial length of the roller 8, or, alternatively, one full width inking device may be present.

Each inking device comprises a body portion 40 carrying an axially extending sealing member in the form of a plastics baffle 41 spaced from the cylindrical surface 10 of the roller 8 by less than 0.5 mm and mounted normally with respect to the surface 10. The body portion 40 also carries an axially extending doctor blade 42 which contacts the cylindrical surface 10 of the roller 8. This blade 42 is flexible and formed, for example, of steel and is displaceably mounted on the body portion 40 so that it can be moved towards or away from the cylindrical surface 10 of the roller 8. In the embodiment shown in the drawings, the doctor blade 42 is shown contacting the surface 10 in the reverse angle position. However, in another embodiment, the doctor blade 42 may contact the surface 10 in a trailing position. Seals 48 having edges bearing against the roller 8 are provided at each end of the inking device. The baffle 41, blade 42, and body portion 40 fit together in a fluid tight manner to form a fluid tight chamber which is closed, or substantially closed, by the surface 10 of the roller 8 when roller 8 rotates so as to define an essentially closed ink duct extending along the width of the inking device. The body portion 40 also includes a protruding edge 44 extending along the width of the duct, the edge 44 being slightly spaced from the cylindrical surface 10 of the roller 8. Ordinarily, the gap between the protruding edge 44 and the cylindrical surface 10 of the roller 8 will be less than 0.5 mm. The protruding edge 44 divides the ink duct into a first zone 45 and a second zone 46. The body portion 40 incorporates an ink feed conduit 47 which terminates in a first reservoir 61 which extends axially along the full width of the device 12. Reservoir 61 is linked, along its whole width, with an inlet for the first zone 45 in the form of a narrow axially extending slot 62 debouching into the first zone 45. If desired, a plurality of conduits 47 may be provided to feed ink to the reservoir 61. The body portion 40 also incorporates an ink discharge conduit 49 leading from a second axially extending reservoir 63 which extends along the full width of the device 12 and is linked along its entire width with an outlet of the second zone 46 in the form of a second axially extending slot 64 communicating with the second zone 46. This arrangement enables ink to egress from the second zone 46 of the ink duct. The second slot 64 is rather wider than the first slot 62 and a plurality of conduits 49 may be provided to discharge ink from the reservoir 63.

The free end of the ink feed conduit 47 terminates in a connector 65 whereby the ink feed pipe 18 (see FIG. 1) may be detachably connected thereto so that ink can be fed to the duct from its respective reservoir 17 via the pump 19 and the filter 20 associated therewith. The free end of the ink discharge conduit 49 terminates in a connector 66 whereby the ink discharge pipe 21 (see FIG. 1) may be detachably connected thereto so that ink can be conducted back to its reservoir 17.

In use ink is pumped from the reservoir 17 under pressure through the filter 20 and into the first zone 45 of the ink duct via ink feed pipe 18, conduit 47, reservoir 61, and slot 62. The ink flows between the protruding edge 44 and the surface 10 of the roller 8 and into the second zone 46 of the ink duct and thence returns via slot 64, reservoir 63 and ink discharge pipe 21 back to the reservoir 17. The path of the ink through the ink duct is denoted by dotted line 67. Thus there is a continuous flow of ink from the reservoir 17 to the duct and back to the reservoir 17. During printing, rotation of the roller 8 in the direction of the arrow (i.e. in the same direction as the ink flow) transfers ink at high velocity through the narrow linear constriction defined by the edge 44 and thus high rates of shear are applied to the ink. The pressure level in this second zone 46 is controlled by relieving the pressure via the variable valve 22 which can be preset as desired. Alternatively, the valve 22 may be replaced or supplemented by a vent having a specific area appropriate to the system so that the pressure in the second zone 46 is at the desired value. Generally the pressure in the second zone 46 will be from 1 to 10 psi.

It is believed that the effect of the high shear rate applied to the ink at the constriction as it transfers from zone 45 to zone 46 ensures that ink with constant rheological properties and without entrained air or fountain solution completely fills the cells of the engraved roller 8. Similar principles apply at slot 62 and both the constriction and the slot 62 tend to produce an even level of emulsification in the ink. The ink from the engraved roller 8 is transferred via the forme rollers 11 to the lithographic printing plate 2 where the water repellent ink-receptive printing image takes the ink away from the forme rollers 11. Ink is not received by the non-printing areas which have previously been wetted with fountain solution by the spray means 13. Ink is transferred from the printing image to blanket 6 and thence to web 28 of paper or the like passing through the nip between the blanket cylinder 4 and the impression cylinder 7. Where ink is not taken away from the forme rollers 11 by the printing image of the plate 2, it returns to the cells of the engraved roller 8 and is replaced with ink from the pressurised duct as the engraved roller 8 rotates through the constriction and the higher pressure zone 46. The baffle 41 prevents contaminants entering the duct and also confines the ink within the duct during operation of the press. Ink is removed from the surface 10 by the doctor blade 42 and is returned to the reservoir 17 via the second zone 46 within which the ink is contained.

Lithographic printing ink is a thick thixotropic material and it has been found that an even flow of ink can be achieved by means of the duct of the invention. More particularly, the presence of the first slot axially extending across the full width of the duct and axially communicating with the first reservoir across their full lengths eliminates dead spaces where the ink would have a tendency to become thicker due to its thixotropic characteristics. Thus an even distribution of ink across the duct can be obtained. Similarly, the presence of the similarly arranged second slot and reservoir ensures rapid exit of ink and prevents dead spaces being formed in the return section of the ink path.

By appropriately setting the doctor blade 42, a consistent amount of deaerated and appropriately conditioned ink (i.e. an amount determined by the volume of the cells) is transferred to the forme rollers 11 and thence to the printing plate 2. The cells in the surface 10 are completely filled with ink. Because of this, there is no possibility of aqueous fountain solution finding its way into the cells and thereby preventing the cells from being occupied by ink. The amount of ink carried by the roller 8 is consistent and thus little or no operator involvement is required at the inking device. The necessary balance between the amount of ink and water on the printing plate may be determined by controlling the amount of aqueous fountain solution applied to the printing plate, and once this balance has initially been set up for constant operating conditions, no further adjustments need to be made during printing other than to compensate for changes in speed. By means of the present invention, the printing plate is provided with the optimum amount of ink which it needs irrespective of the speed of the press and thus much of the waste ordinarily produced at the start of a printing run can be reduced.

In the embodiment shown, four inking devices are provided across the width of the printing press and the press is such that it can receive a web which has a width corresponding to four pages, each page being associated with one of the inking devices. In this way, four pages can be printed simultaneously. If, however, it is desired to use a narrower web and print less than four pages simultaneously, the appropriate number of inking devices can be taken out of service or be removed altogether after slackening bolts 39. In this way, only the number of inking devices appropriate to the width of the web being printed are used. If desired, each inking device may contain ink of a different colour so that, for example, four colours can be applied to a four page width web simultaneously. The inking devices are interchangeable so that they may readily be moved axially along the roller surface from one position to another as desired to facilitate printing in different colours. Printing in different colours can also be effected by disconnecting the ink feed and ink discharge pipes of a given inking device and connecting the ink feed and ink discharge pipes associated with a reservoir containing ink of a different colour.

In the embodiment shown, the aqueous fountain solution is applied directly to the lithographic printing plate 2 on the plate cylinder 1 by a spray mechanism. However, the fountain solution may be applied by rollers. Moreover, if desired, the solution may be applied either to one or both of the forme rollers 11 or to the roller 8. If desired, a rider roller 50, with or without reciprocation, may be provided on the or each forme roller 11.

Referring now to FIG. 4, parts corresponding to parts of FIGS. 1 to 3 are denoted by like reference numerals.

In this case, the axially extending sealing member is in the form of an integrally formed protrusion 81 on the metal body portion 40 rather than in the form of a plastics baffle 41. Moreover the inking device 12 includes an additional axially extending doctor blade 71 which is located on the opposite side of sealing member 81 to the protruding edge 44. Doctor blade 71 is in contact with the cylindrical surface of the roller and forms another zone 72 on the opposite side of the first zone 45 to the second zone 46. An outlet 73 is provided for zone 72. During printing the inking device 12 operates in the same manner as previously described with reference to FIGS. 1 to 3. When it is desired to change the printing plate mounted on the plate cylinder (not shown in FIG. 4), it is necessary to reverse the direction of rotation of the plate cylinder and this causes a corresponding reverse rotation of roller 8. The first zone 45 is full of ink and rotation of roller 8 in the reverse direction causes some of this ink to be carried past the sealing member 81 in the form of an ink film on the surface of the roller 8. However this ink film is removed from the surface by the additional doctor blade 71 and eventually returned to the reservoir 17 (not shown) via the zone 72 and outlet 73.

The inking device 12 is secured to one face of a support member 74 by bolts 75. A similar inking device 12' is similarly mounted on an opposite face of the support member 74. Inking device 12' is identical to inking device 12 except that it is mounted on the support member 74 so as to be a mirror image of inking device 12. Thus inking device 12' includes a first doctor blade 42', a sealing member 81', a protruding edge 44' and an additional doctor blade 71' which are identical to the corresponding features of inking device 12. The support member 74 is pivotally mounted about a horizontal axis 76 which lies vertically below the axis of rotation 9 (not shown) of roller 8.

When printing in a first mode, the inking device 12 co-operates with an upwardly moving part 10' of the cylindrical surface of the rotating roller 8. The direction of rotation of the press can be altered for printing in a second mode using, for example, ink of a different colour. In this case, the support member 74 is pivoted about its axis 76 so that inking device 12 moves out of contact with the part 10' of the cylindrical surface of roller 8 and the inking device 12' is brought into co-operation with part 10'' of the cylindrical surface of roller 8 which, in this mode, is an upwardly moving surface.

The pivotal mounting of the inking devices 12 and 12' also has the additional advantage of providing ease of access for maintenance purposes.

Referring now to FIG. 5, parts corresponding to parts of FIGS. 1 to 4 are denoted by like reference numerals. In this case, the slot 64 is increased in width so that there is substantially no constriction between the zone 46 and reservoir 63. This helps to prevent excess pressure developing in the zone 46 and also facilitates the passage of ink through the reservoir 63 and back to reservoir 17 via conduit 49 and discharge pipe 21.

I claim:

1. An ink duct for containing ink under pressure and for applying the ink to the surface of a roller mounted for rotation about its cylindrical axis and having a cylindrical surface, said duct comprising a chamber having:

(i) an open side with dimensions which may be substantially closed by the roller surface, said open side being bounded by (a) an axially extending blade having ends and an edge protruding toward the open side for contacting the roller surface to exert a doctoring action thereon, (b) an axially extending sealing member having ends and an edge protruding toward the open side, said sealing member edge being located at no more than a slight space away from the roller surface, and (c) end seals linking the blade and the sealing member at their ends and having edges protruding toward the open side for sealing engagement with the roller surface, (ii) an axially extending projection located between the blade and the sealing member and having an edge protruding toward the open side in order to divide the chamber into first and second zones while enabling ink to flow past the edge from the first zone to the second zone, (iii) a first axially extending slot in the first zone for the introduction of ink into the first zone, (iv) an axially extending first reservoir communicating with the first axially extending slot along their respective axial lengths, (v) a second axially extending slot in the second zone for egress of ink from the second zone, and (vi) an axially extending second reservoir communicating with the second slot along their respective lengths.

2. A lithographic printing press as claimed in claim 1 and including two of said ink ducts mounted on a support which is pivotable about a horizontal axis so that by suitably pivoting the support about said axis, either a first of said ink ducts can be brought into co-operation with a first part of the cylindrical surface of the roller while the second of said ink ducts is moved out of contact with a second part of the cylindrical surface of the roller or the second of said ink ducts can be brought into co-operation with the second part of the cylindrical surface of the roller while the first of the ink ducts is moved out of contact with the first part of the cylindrical surface of the roller.

3. An ink duct for containing ink under pressure and for applying the same to the surface of a roller mounted for rotation about its cylindrical axis, which duct comprises a chamber having:

(i) an open side capable of being substantially closed by a surface of the roller and bounded by (a) an axially extending blade having an edge protruding toward the open side for contacting the roller surface to exert a doctoring action thereon, (b) an axially extending sealing member having an edge protruding toward the open side for contacting, or for being slightly spaced from, the roller surface, and (c) end seals linking the blade and the sealing member at their ends and having edges protruding toward the open side for making a sealing engagement with the roller surface, (ii) an axially extending projection located between the blade and the sealing member and having an edge protruding toward the open side to divide the chamber into first and second zones while allowing ink to flow past the edge from the first zone to the second zone (iii) an axially extending slot in the first zone for introducing ink into the first zone, and (iv) an outlet in the second zone for egress of ink from the second zone, said outlet in the second zone being in a form of a second axially extending slot.

4. An ink duct as claimed in claim 3 wherein the chamber includes an additional axially extending blade on an opposite side of the sealing member with respect to the axially extending projection, said additional blade contacting the roller to remove ink carried beyond the sealing member on a reverse rotation of the roller and forming another zone at said opposite side, and said another zone including an outlet for egrees of ink.

5. An ink duct as claimed in claim 3 which includes an axially extending reservoir communicating with the slot along their respective axial lengths.

6. An ink duct as claimed in claim 5, wherein the reservoir includes a plurality of conduits for feeding ink to the reservoir.

7. An ink duct as claimed in claim 3 which includes an axially extending reservoir communicating with a second slot along their respective axial lengths.

8. An ink duct as claimed in claim 7 wherein the reservoir includes a plurality of conduits for feeding ink from the reservoir.

9. A lithographic printing press comprising:

(i) a plate cylinder mounted for rotation about its cylindrical axis and adapted to receive a lithographic printing plate, (ii) a means of applying an aqueous fountain solution to the lithographic printing plate, (iii) an inking device for applying ink to an engraved roller mounted for rotation about its cylindrical axis and having a cylindrical surface provided with a plurality of cells, said device comprising:

(a) an ink duct as claimed in claim 3 for containing ink under pressure, (b) means for supplying ink from an ink source to the slot of the first zone of the chamber of the duct and then into contact with said surface and into said cells, (c) means for returning ink from the outlet of the second zone of the chamber of the duct to said source, (iv) means for transferring ink from said cells to the lithographic printing plate, and (v) means for transferring ink from said lithographic printing plate to material which is to be printed, said press including two of said ink ducts mounted on a support which is pivotable about a horizontal axis so that by suitably pivoting the support about said axis, either a first of said ink ducts can be brought into co-operation with a first part of the cylindrical surface of the roller or a second of said ink ducts can be brought into co-operation with a second part of the cylindrical surface of the roller.

10. A lithographic printing press as claimed in claim 9 wherein the axially extending sealing member is spaced from the roller surface by a distance of less than 1.0 mm.

* * * * *